US005803500A

United States Patent [19]

Mossberg

[11] Patent Number: 5,803,500

[45] Date of Patent: Sep. 8, 1998

[54] METHOD AND KIT FOR CONDUCTING AN AUCTION

[76] Inventor: Björn E. F. Mossberg, 4075 Aberdeen Way, Houston, Tex. 77025-2305

[21] Appl. No.: 825,250

[22] Filed: Mar. 27, 1997

[51] Int. Cl.[6] ..... B42D 15/00

[52] U.S. Cl. ..... 283/67; 283/60.1; 283/66.1

[58] Field of Search ..... 283/81, 67, 70, 283/48.1, 49, 51, 60.1, 60.2, 66.1, 66.2, 115, 117

[56] References Cited

U.S. PATENT DOCUMENTS 4,549,658 10/1985 Sfikas ..... 402/79
4,803,795 2/1989 Questel et al. ..... 402/79 X
4,832,372 5/1989 Young ..... 281/31
5,199,743 4/1993 Rosinski, III ..... 281/31 X
5,393,157 2/1995 Basmajian ..... 281/38 X

*Primary Examiner*—Willmon Fridie, Jr.
*Attorney, Agent, or Firm*—Vaden, Eickenroht & Thompson, L.L.P.

[57] ABSTRACT

A method and kit for conducting a silent or live auction or some combination thereof. The method includes identifying each potential bidder, auction item, and potential sales prices with a unique identification code that is machine readable using optical or electronic means. The codes are most preferably bar codes that may be read using a standard retail industry scanner. The codes are printed on adhesive labels for use by the bidders in placing bids on auction items. A bid may be placed on an item by affixing the appropriate labels to a bid sheet. Bid sheets may be prepared with item codes and descriptions.

23 Claims, 6 Drawing Sheets

AuctionStar Statistics

61 — The Generic Montessori School - 1/1/96 — 62

1/14/97 06:44:08 pm

Tables & Guests

| | Count |
|---|---|
| Tables | 41 |
| Guests | 392 |
| Bidders | 230 |
| Bidders per 100 Guests | 59 |

Bidders vs. Buyers

| | Count | % of All | Number of Bids per Bidder: Average | Maximum |
|---|---|---|---|---|
| All Buyers | 140 | 61 | 18 | 93 |
| Bidders who bid but won nothing | 38 | 17 | 4 | 15 |
| Bidders who didn't bid at all | 52 | 23 | 0 | 0 |
| All Bidders | 230 | 100 | 11 | 93 |

Spending

Three distinct bidder groups each contributed one third of the total revenue.

63

| | Count | % of All | % of Buyers |
|---|---|---|---|
| Heavy Spenders | 6 | 3 | 4 |
| Moderate Spenders | 12 | 5 | 9 |
| Light Spenders | 122 | 53 | 87 |

Invoices

| | |
|---|---|
| Lowest Amount | $20 |
| Bidder Average | $390 |
| Buyer Average | $641 |
| Highest Amount | $4,150 |
| With 15 or More Items | 4 |
| With 20 or More Items | 1 |
| Largest Number of Items | 23 |

64

Silent Auction Item Trivia

| | |
|---|---|
| Average Size of an Opening Bid | $47.48 |
| Average Actual Bid Increment | $13.13 |
| Number of Bids on the Hottest Item | 30 |
| Items Needing More than 1 Bid Sheet | 8 |
| Items Needing More than 2 Bid Sheets | 2 |

65

Silent Auction Bidder Trivia

| | |
|---|---|
| Total Number of Bids by Buyers | 2456 |
| Total Number of Bids by Non-Buyers | 169 |
| Bidders Using More than ½ Label Sheet | 10 |
| Bidders Using More than 1 Label Sheet | 1 |

66

67

AUCTION RESULTS

| | Item Counts: IDs | For Sale | Unsold | Sold | Item Values: Unsold | Sold | Revenue |
|---|---|---|---|---|---|---|---|
| Live Auction Items | 16 | 17 | 0 | 17 | $0 | $24,036 | $33,400 |
| Standard Silent Auction Items | 503 | 497 | 23 | 474 | $4,617 | $53,112 | $48,209 |
| Fixed Price Items | 50 | 50 | 0 | 50 | $0 | $2,000 | $2,500 |
| Multiunit Items | 6 | 120 | 8 | 112 | $200 | $5,600 | $5,600 |
| All Items | 575 | 684 | 31 | 653 | $4,817 | $84,748 | $89,709 |

AuctionStar Copyright © 1997 CrestWare Inc. Phone: 713-667-3373 Fax: 713-667-8325 E-mail: mossberg@mindspring.com

60

FIG. 2

18 13

The Generic Montessori School - 12/31/96

Live Auction Item 11 15

2010 Viva Madrid!

Slip away with your amour to Madrid, and let the Southern European easy going life style put the stars back in your eyes. Delight in the sights, the cuisine, the wine and the culture. Two Y class, round trip, non-upgradeable, non-transferable, Houston/Madrid tickets. Must be issued and used by December 31, 1997.

Estimated Donor Value: $4900 Expires: 12/31/97

Donor: El Grupo Aéreo España.

24 25 26 28

Unit #____ BidID:_____ Price: $_____ Bidder Label Price Label

22

Unit #____ BidID:_____ Price: $_____ Bidder Label Price Label

Unit #____ BidID:_____ Price: $_____ Bidder Label Price Label

Unit #____ BidID:_____ Price: $_____ Bidder Label Price Label

Unit #____ BidID:_____ Price: $_____ Bidder Label Price Label

Unit #____ BidID:_____ Price: $_____ Bidder Label Price Label

Unit #____ BidID:_____ Price: $_____ Bidder Label Price Label

Unit #____ BidID:_____ Price: $_____ Bidder Label Price Label

Unit #____ BidID:_____ Price: $_____ Bidder Label Price Label

Unit #____ BidID:_____ Price: $_____ Bidder Label Price Label

AuctionStar Copyright © 1997 CrestWare Inc. Phone: 713-667-3373 Fax: 713-667-8325 E-mail: mossberg@mindspring.com

20

The Generic Montessori School
30th Anniversary Gala
12/31/96

Auction Purchases by
Bert & Angie Bartok

34

55

| | Item | Title | Donor Value | Price | OK |
|---|---|---|---|---|---|
| <CERT> | 101 | Every girl's dream slumber part | $25 | $100 | |
| <CERT> | 101 | Every girl's dream slumber part | $25 | $100 | |
| <CERT> | 113 | Belly flops and more! | $15 | $50 | |
| <CERT> | 119 | This is your chance! | $100 | $150 | |
| <CERT> | 201 | Mother-daughter tea party | $15 | $20 | |
| | 444 | Signed by Brent Askenazy | $125 | $195 | |
| <CERT> | 603 | California Wine tasting | $20 | $25 | |
| | 823 | Gift basket | $50 | $20 | |

Total Invoice $660

11 13 58 56

52

Thank you for your purchase of the above auction item(s). The Generic Montessori School Inc. is an IRC Section 501(c)(3) tax-exempt organization. The amount of your contribution that is deductible for federal income tax purposes is limited to the excess of any money (and the value of any property other than money) paid over the value of goods or services received. A good faith estimate of the value of the goods and/or services you have purchased in the auction is $0.

Thank you so much for supporting our wonderful school!!

Please present this claim slip when picking up your items.

ictionStar Copyright © 1997 CrestWare Inc. Phone 713-667-3373 Fax 713-667-8325

50

The Generic Montessori School
30th Anniversary Gala
12/31/96

53 242 36

Bert & Angie Bartok
8632 Pine, Bellaire, TX 77401. Phone: 990-8867

| | Item | Title | Donor Value | Price |
|---|---|---|---|---|
| <CERT> | 101 | Every girl's dream slumber party | $25 | $100 |
| <CERT> | 101 | Every girl's dream slumber party | $25 | $100 |
| <CERT> | 113 | Belly flops and more! | $15 | $50 |
| <CERT> | 119 | This is your chance! | $100 | $150 |
| <CERT> | 201 | Mother-daughter tea party | $15 | $20 |
| | 444 | Signed by Brent Askenazy | $125 | $195 |
| <CERT> | 603 | California Wine tasting | $20 | $25 |
| | 823 | Gift basket | $50 | $20 |

Total Invoice $660

54

51

Cash ☐ Check #_____ MC ☐ Visa ☐

Page 1 Printed 1/15/97 05:44:25 am

FIG. 5

FIG. 6

AuctionStar Statistics

The Generic Montessori School - 1/1/96

1/14/97 06:44:08 pm

61

Tables & Guests

| | Count |
|---|---|
| Tables | 41 |
| Guests | 392 |
| Bidders | 230 |
| Bidders per 100 Guests | 59 |

62

Bidders vs. Buyers

| | Count | % of All | Number of Bids per Bidder: Average | Maximum |
|---|---|---|---|---|
| All Buyers | 140 | 61 | 18 | 93 |
| Bidders who bid but won nothing | 38 | 17 | 4 | 15 |
| Bidders who didn't bid at all | 52 | 23 | 0 | 0 |
| All Bidders | 230 | 100 | 11 | 93 |

63

Spending

Three distinct bidder groups each contributed one third of the total revenue.

| | Count | % of All | % of Buyers |
|---|---|---|---|
| Heavy Spenders | 6 | 3 | 4 |
| Moderate Spenders | 12 | 5 | 9 |
| Light Spenders | 122 | 53 | 87 |

64

Invoices

| | |
|---|---|
| Lowest Amount | $20 |
| Bidder Average | $390 |
| Buyer Average | $641 |
| Highest Amount | $4,150 |
| With 15 or More Items | 4 |
| With 20 or More Items | 1 |
| Largest Number of Items | 23 |

65

Silent Auction Item Trivia

| | |
|---|---|
| Average Size of an Opening Bid | $47.48 |
| Average Actual Bid Increment | $13.13 |
| Number of Bids on the Hottest Item | 30 |
| Items Needing More than 1 Bid Sheet | 8 |
| Items Needing More than 2 Bid Sheets | 2 |

66

Silent Auction Bidder Trivia

| | |
|---|---|
| Total Number of Bids by Buyers | 2456 |
| Total Number of Bids by Non-Buyers | 169 |
| Bidders Using More than ½ Label Sheet | 10 |
| Bidders Using More than 1 Label Sheet | 1 |

67

AUCTION RESULTS

| | Item Counts: IDs | For Sale | Unsold | Sold | Item Values: Unsold | Sold | Revenue |
|---|---|---|---|---|---|---|---|
| Live Auction Items | 16 | 17 | 0 | 17 | $0 | $24,036 | $33,400 |
| Standard Silent Auction Items | 503 | 497 | 23 | 474 | $4,617 | $53,112 | $48,209 |
| Fixed Price Items | 50 | 50 | 0 | 50 | $0 | $2,000 | $2,500 |
| Multiunit Items | 6 | 120 | 8 | 112 | $200 | $5,600 | $5,600 |
| All Items | 575 | 684 | 31 | 653 | $4,817 | $84,748 | $89,709 |

AuctionStar Copyright © 1997 CrestWare Inc. Phone: 713-667-3373 Fax: 713-667-8325 E-mail: mossberg@mindspring.com

60

METHOD AND KIT FOR CONDUCTING AN AUCTION

BACKGROUND OF THE INVENTION

1. Field of the Invention

This invention is concerned with a method and kit for conducting auctions. Auctions are conducted for charitable or non-profit purposes as well as commercial for-profit ventures. They may be conducted on a silent or live basis or using some combination of the two. This invention is primarily focused on silent auctions, but also includes a method for conducting live auctions.

2. Description of Prior Art

Auctions are conducted to generate revenue for various purposes. In the case of charitable auctions, items are donated to the auction sponsor who then arranges for an auction site and time at which persons interested in the items and/or the underlying charitable purpose attend and bid on the donated items.

In the case of a silent auction, it is typical that the item and/or a description of the item will be made available for inspection and bidding. Bids could be made by the auction participants by means of writing their name and bid amount on a bid sheet. At the conclusion of the auction, the bid sheets would be collected and the winner announced after determining the highest bidder. The purchase data for a specific auction item, consisting of the name or other data identifying the winner, the winning bid price, and the number or other identifying data of the purchased auction item, are collected and recorded in some manually based ledger system or in a computer. Generally, prior to the present invention no means for collecting such data using an automated or otherwise machine based method has been known. Although computers have been widely employed in managing auction data, prior to the present invention the actual purchase data has always been entered manually, i.e., by means of keyboard entry, or typing. No method has been known by which to enter all data relevant to the sale of an auction item in an automated or otherwise machine based way.

This "manual" method of conducting the auction is disadvantageous because the creation of auction records is both time consuming and likely to incur errors in transcribing information. Further, because the method is so time consuming it is not uncommon for the auction sponsor to have to stagger the auctioning a various items in order to prevent excessive delays in recording sales and invoicing purchasers. This staggering of items shortens the time period for bidding on the items and thus depresses the winning bid price.

In the case of a live auction, the winning bid for an auction item is usually determined via a dialog between an auctioneer and the guests, and finalized by the auctioneer when no more bids can be solicited from the guests. However, the method used for the recording of purchase data for a live auction item does not generally differ from the method used for silent auction items.

U.S. Pat. No. 3,837,682 entitled "Method And Apparatus For Accounting", issued to Feller, describes a method and sales kit for use in accounting for sales and purchases of items at an auction. In the invention, each bidder is assigned a bidder's identification number and the identifying number is recorded on both parts of a two part identification tag. One part is retained by the bidder for use at the auction while the second part is marked with the bidder's name and address and stored on a peg board in numerical order during the auction. The sale of each item is recorded on a sales slip. The sales slips are stored during the auction with the second part of the bidder's identification tag after each sale has been duplicated on a permanent sales record.

After the auction, the second part of the bidder's identification tag and the corresponding sales slips are used to record the dollar amount of the sales on a duplicate sales settlement slip. One copy of the duplicate sales settlement slip plus the original of the corresponding individual sales slips are given to the purchasing bidder while the copies of the sales slips are stored in numerical order as a permanent record of the sales.

Although this invention provides a method of allocating multiple sales to individual purchasers for compilation at the conclusion of the auction, it continues to rely on the hand entry of all sales information. Thus, this method does not significantly reduce the time required to compile the information nor does it eliminate errors that may arise due to errors in transcription.

Therefore it is a feature of the present invention to provide an improved method and kit for conducting either live or silent auctions or some combination thereof, the invention having both human and machine readable codes which are allocated to the auction participants, auction items and bid prices. After an auction item is sold, an optical scanning or other electronic reading device is used to read the codes defining the purchase and transmit them in computer readable form to a computer where they are automatically recorded in a database, thereby creating a permanent sales record. Prior to the auction, a description of each auction item and personal information concerning each bidder are entered into the database, and a unique identifying code is assigned to each auction item as well as to each bidder. At the conclusion of the auction, sales information is compiled and sorted by bidder as well as item code, and a single invoice is generated for each purchaser. Various records concerning the auction and all items involved may also be generated from the database based upon the needs of the auction sponsor.

It is still another feature of the present invention to facilitate the conducting of an auction in a manner that will maximize revenue. The method of bidding by affixing a bid label next to a pre-printed price on a bid sheet, as opposed to having to manually write bidder name and bid amount, greatly facilitates bidding and therefore increases bid frequency. Although additional bid prices may be printed at any time, the pre-printing of bid prices affords the auction organizer a method of controlling the bidding in a manner that cannot be readily circumvented by bidders, thereby creating ways to further maximize revenues.

It is another feature of the present invention to minimize the time required for the recording and processing of sales data. High speed scanning of sales information and automated invoicing for purchasing participants minimize the delays that customarily occur at an auction's conclusion yielding several advantages. Foremost, one can minimize or eliminate the need to stagger the auctioning of individual items, and thus, increase the bidding time allowed for each item. Increased bidding time provides for increased bid prices for the auctioned items. Secondly, by reducing or eliminating the delay at the auction's conclusion, a purchasing bidder is less likely to leave the auction early in frustration without having made payment or obtained the purchased item, and thus, the auction sponsor's workload after the close of the auction is greatly reduced.

It is still yet another feature of the present invention to simplify the recording of auction sales information, and to all but eliminate transcription errors during that process. The exclusive use of high-speed scanning for all purchase data entry achieves these objectives. However, it should be noted that the presence of human readable representations of all codes wherever machine readable codes exist provides for a fallback using manual (keyboard) entry in case of illegible machine readable codes or equipment malfunctioning.

It is still another feature of the present invention to provide an efficient means for invoicing purchases and collecting and recording payment at the conclusion of the auction. Optionally, auction participants may allow the auction sponsor to scan a credit or debit card prior to the auction to facilitate a quick checkout at the auction's conclusion.

BRIEF DESCRIPTION OF THE DRAWINGS

These and other objects, advantages and features of this invention will be apparent to those skilled in the art from a consideration of this specification including the attached drawings and appended claims.

In the drawings:

FIG. 2 is a reduced size example of a bid sheet for use in a live auction to sell an auction item in either single or multiple units.

FIG. 5 is a reduced size example of two part sales invoice prepared for each purchasing bidder.

FIG. 6 is a reduced size sheet bearing a sample of the compilation of various record reports that may be generated using the data processing means of the present invention.

DESCRIPTION OF THE PREFERRED EMBODIMENTS

The present invention is directed to a method for conducting an auction, regardless of whether the auction is conducted on a live or silent basis or a combination of the two. The following description of the present invention is set out in terms of a charitable, non-profit auction that combines the auctioning of items in both live and silent formats. It should be realized however, that the method and kit of this invention are equally applicable to auctions that are conducted on a for-profit basis and that the following description should not be considered to be limiting of the scope of the invention.

In a charitable auction, auction items are donated to the charity sponsoring the auction for the purpose of being auctioned off in order to generate revenue for the charity. As used in this specification, an auction item may include a tangible good or group of goods or a certificate entitling the bearer to specific goods or services, or any combination thereof. Further, more than one unit of certain auction items may be made available for sale, such as a set of invitations to a dinner. Bidders may purchase such a multi-unit item by signing up to pay the fixed price.

In the method of this invention a unique identification code is allocated to each item. The item code is a string of characters from the ASCII, ANSI, UNICODE or other character set representable in a computer, including but not limited to, numbers and/or letters, which when taken as a whole uniquely identify the item in question. The item code will also have a corresponding representation that is machine readable using an optical scanning or other electronic reading device. A machine readable code includes but is not limited to a bar code such as is used for universal product codes as are commonly used in retail merchandising transactions. Alternatively, it is anticipated that a machine readable bidder code may be encoded into a magnetically encoded card that is provided to each potential bidder during the auction for use in placing bids on various items.

Prior to the conducting of an auction, information concerning invitees to the auction and other potential bidders is compiled. Bidder codes are assigned to each of the potential bidders. The bidder codes are similar in nature to the auction item codes except that they uniquely identify each potential bidder. Bidders at an auction may be defined as one or more persons, one or more business entities, or some combination thereof, characterized by having the intention to unifiedly bid on auction items. A bidder, or a representative of the bidder, must be physically present at the site of the auction in order to place a bid.

Codes are also assigned to various bid prices that may be used during the auction. Each price code represents a unique, well defined price, expressed in U.S. dollars or any other currency deemed appropriate by the auction sponsor.

Figure 1:
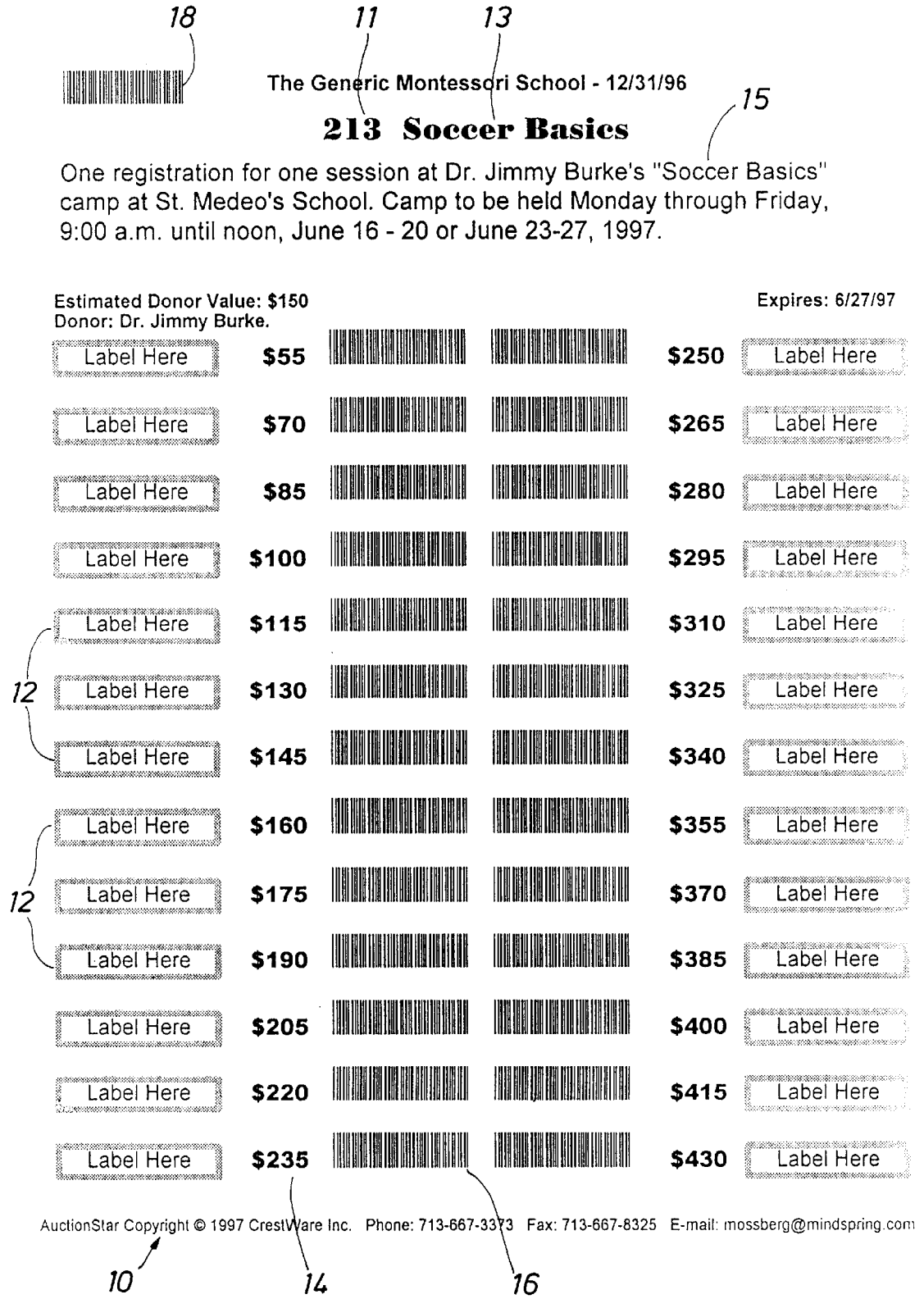
FIG. 1 is a reduced size example of a bid sheet for a single auction item such as might be used in a silent auction.

In the method of this invention as carried out in a silent auction format, the auction items and/or descriptions of the items are made available for inspection by the potential bidders. FIG. 1 shows a reduced size example of a bid sheet 10 wherein bidders can place a bid on the item by registering their bidder code in a space 12, typically, but not necessarily, by means of affixing an adhesive bid label bearing a bidder code. Bid sheet 10 is provided with an item description 20, item title 13, item code 11 in human readable form and a corresponding item code 18 in machine readable form. Further, bid sheet 10 is provided with various machine readable price codes 16 with their corresponding human readable representation set out adjacently at 14. The minimum prices and the incremental values between prices as shown on bid sheet 10 are determined prior to the auction, and are usually based on a suggested value of the donated item.

At the conclusion of the auction, the winner of a silent auction item is determined from the item's bid sheet. The codes for the item as well as the winning bidder and associated price are recorded. A convenient method for recording the codes is to use a standard hand held retail industry optical bar code scanner, it is anticipated that with a sufficient advance in technology it may become more efficient to read the whole bid sheet using a flatbed scanner. Regardless of the method used to read the codes, they are then transmitted in computer readable form to a computer linked to the reading device via cable, modem or other electronic means.

As an alternative to the silent auction method described above, it is anticipated that the placing of bids may be accomplished by encoding the bidder code into a magnetically encoded card that would be provided to each potential bidder. Item and price codes would be pre-programmed into a computer database that would be accessible through a card reading device located adjacent each silent auction item. Access to the database through the device would require a potential bidder to insert their bidder card and code into the device before placing a bid on the item. In this way bids placed on an item would be recorded directly into the computer database and would allow real time monitoring of bids.

In the method of this invention as carried out in a live auction format, the procedure closely follows the standard procedure used in most live auctions up to, and including, the determination of the winner and the price to be paid. An auctioneer enters into a dialog with an audience consisting of potential bidders, which, in turn, announce their bids by hand waving or other visual or electronic method. The final bid is determined by the absence of subsequent bids, and by the auctioneer's announcement that the bidding for the auction item in question is closed.

FIG. 2 shows a reduced size example of a live auction bid sheet 20 wherein auction staff at the close of the bidding for a particular item first make manual entries of the winning bidder code and price. Subsequently, while the auctioneer and bidder audience are focusing on the next live auction item, the appropriate bid label and price label bearing machine readable codes are located in two sets of pre-printed labels available for this purpose. The labels are affixed in the locations 26 and 28, respectively, rendering all bid information machine readable in the same manner as is normally the case with silent auction bid sheets. Space is available for more than one unit of the live auction item in case a donor decides to make additional units available for sale. The same unit of an item can also be shared between two or more bidders. Distinctions between multiple units and sharing can be made by specifying unit numbers in space 22.

Thus, in the method of this invention, the live auction bid recording process can be reduced to the same format as that of silent auctions, with an associated reduction of human transcription errors to almost zero. Furthermore, the preprocessing of the live auction bid sheet for a particular item is done while the subsequent live auction item is being auctioned out, significantly reducing the time required to invoice winning bidders.

Once all of the items, or a predetermined subset of items, have been auctioned, all of the corresponding sales are recorded. The sales are then compiled and sorted according to bidder as well as item codes. A single invoice is prepared for each bidder, itemizing the auction items purchased up to that point, and providing a sum of the auction prices for those items. Further, the invoice should contain a space adjacent each item code or description for indicating whether the item has been delivered to the bidder. In addition, the invoice should be prepared in duplicate with the copy to be retained by the auction sponsor. The sponsor's copy of the invoice may be identical or it may include additional information such as the bidder's payment information. Lastly, the recorded sales information can be used to prepare various auction records for use by the auction sponsor as desired.

Preferably, the compilation and sorting of all sales information, and the preparation of bidder invoices is performed using a computer database program. Likewise, various auction records can be prepared for the auction sponsor using these data processing features operating on the recorded codes and the other information stored in the database. One or more printers should be available prior to and during the auction in order to print bid labels and bid sheets as necessary, as well as to print bidder and auction reports and invoices at the conclusion of the auction.

After the auction is concluded and the bidder invoices have been prepared and printed, the bidder pays the amount due and proceeds with obtaining the items purchased. To reduce the time required for payment, bidders have the option of pre-paying for auction items. Pre-payment can be accomplished such as by giving the auction sponsor access to the bidders credit or debit card account by scanning a bid label and account information into the database prior to or during the auction, automatically connecting bidder code and credit card information.

After payment is completed, the purchased items are delivered to the bidder. As the items listed on the bidder's invoice are delivered to the bidder, a representative of the auction sponsor will indicate on the invoice that the particular item has been delivered to the bidder.

Figure 3:
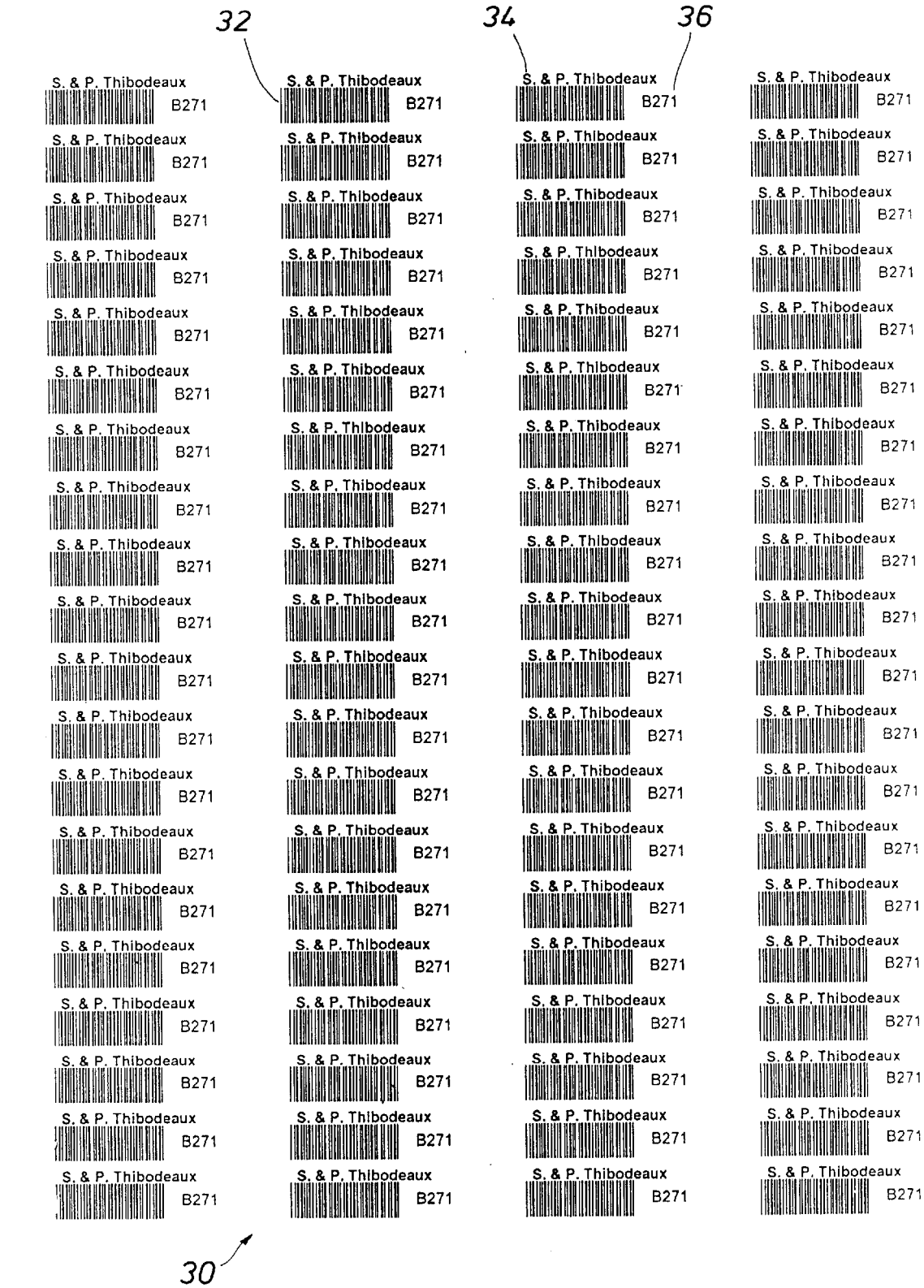
FIG. 3 is a reduced size sheet bearing multiple adhesive bidder labels.

The kit of the present invention will contain a number elements for conducting the auction including bidder, auction item and price codes as are discussed above. The bidder codes are typically machine readable codes that are printed on a set of adhesive labels. FIG. 3 shows a reduced size sheet 30 of bidder codes such as would be provided to a bidder upon arriving at an auction. Sheet 30 contains multiple labels each bearing that auction participant's unique bidder code 32 in machine readable format, the bidder's code 36 in a corresponding human readable format and optionally the bidder's name 34. A sheet of bid labels is provided to each potential bidder so that they may place bids on various auction items as is discussed above.

Figure 4:
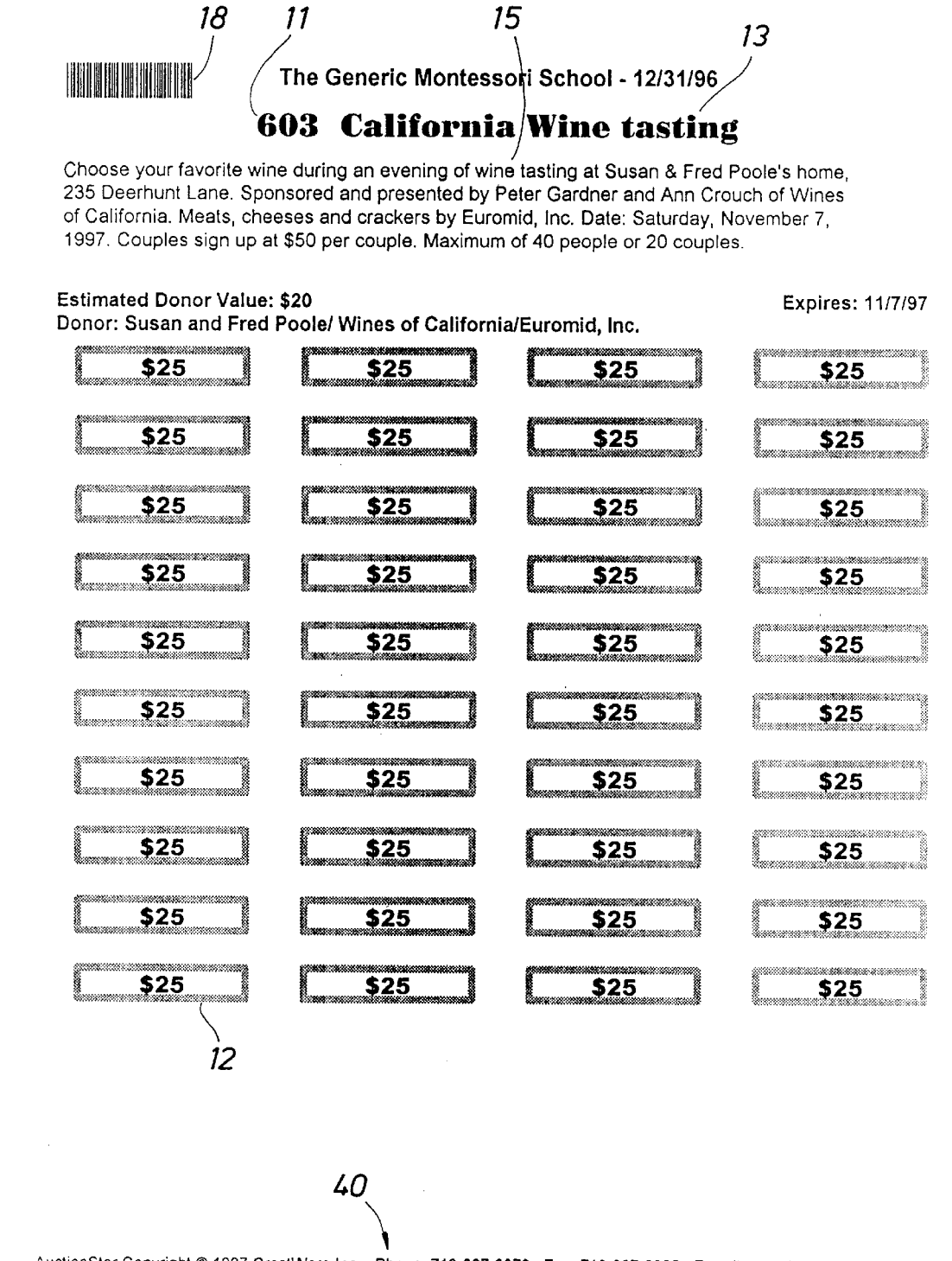
FIG. 4 is a reduced size example of a bid sheet for an item sold in multiple units at a predetermined fixed price.

The item codes are provided on bid sheets. FIGS. 1, 2 and 4 show various types of bid sheets that are pre-printed as needed as part of the kit of the present invention. FIG. 1 shows a reduced size bid sheet 10 for use in auctioning an item under a silent auction format. Sheet 10 is provided with numeric item code 11, item title 13, item description 15 and item bar code 18. Further, sheet 10 is provided with multiple spaces 12 for registering a bidder code or affixing a bidder code label. Adjacent each space 12 is a numerical amount 14 representing the amount of the bidder's bid. A price bar code 16 is provided adjacent and corresponding to the amount 14. Again, bidders may enter a bid on sheet 10 by registering a bidder code in the space adjacent the desired amount of the bid, preferably by affixing a label bearing their code.

FIG. 2 shows bid sheet 20 that can be used in conducting a live auction of a particular item or type of item. Like numbers represent like elements throughout the figures such that item codes, titles and descriptions will not be repeated here. As with most live actions, the bidding for a particular item is opened at some predetermined minimum and the bidding is conducted orally. Bidder codes and price codes need not be recorded until after the bidding is concluded with the highest bid. At that point, the winning bidder code and price code can be recorded on a bid sheet containing the item codes of the different items to be sold at a live auction or on a sheet dedicated to one type of item as is shown in FIG. 2. Bid sheet 20 is an example where more than one unit of one type of item can be auctioned at a live auction. At the conclusion of the oral bidding, the winning bidder and bid are recorded by hand in spaces 24 and 25, respectively. Labels bearing the winning bidder's bar code and the winning price bar code are subsequently applied to sheet 20 in spaces 26 and 28, respectively. As noted, if more than one unit of the item is made available for bid at the auction, sheet 20 is provided multiple lines for those items, identifying each by separate unit number in space 22. These lines may also be used to register two or more bidders as sharing the cost for the same unit of an item.

FIG. 4 is an example of a bid sheet 40 for an auction item that is made available to bidders in multiple units at a predetermined fixed price. Again, spaces 12 are provided for the bidders to register their codes in order to purchase a unit of the auction item. The number of spaces 12 made available on sheet 40 will correspond to the number of units being made available at the auction.

Bid sheets 10, 20 and 40 are examples of the ways in which bids on auction items may be registered. As has been described throughout, bidder, item and price codes are preferably in a machine readable format so that at the conclusion of the auction the codes associated with each sale may be read using either a hand held retail merchandising scanner or other electronic reading device, and transmitted in computer readable form to a computer database. Although auction sales could be compiled and sorted by hand it is preferable that these procedures be conducted within a database utilizing the data processing features of that database. After compiling and sorting all auction sales information, an invoice is prepared for each bidder who purchased one or more auction items. Again, it is preferable that the bidder's invoice be generated using the data processing functions of the database.

FIG. 5 shows a reduced size example of an invoice 50 that could be generated from the present invention. Invoice 50 is broken into two sections, 52 and 54 respectively. Section 52 is the portion of the invoice to be delivered to the purchasing bidder and is provided with the name of the bidder 34, the numerical item code 11, the item title 13, the bid price 55 and a total amount due 58 that is the sum of all the bid prices for the items purchased by the bidder. As shown, section 52 is also provided with boxes 56 for indicating when the items have been delivered to bidder 34.

Section 54 of invoice 50 is the portion of the invoice that is retained for the auction sponsor's records. Section 54 is provided with similar itemized information concerning the items purchased by the bidder but may optionally contain payment information for tracking the revenue generated by sales to that bidder. Further still, section 54 may contain additional information concerning the bidder such as the bidder's human readable code 36 and the bidder's address 53.

The kit of the present invention also includes one or more printers for printing various types of bid sheets prior to and during the auction and further, for printing bidder invoices during or at the conclusion of the auction.

Subsequent to the conclusion of the auction and the distribution of purchased auction items, the database may be used to generate various reports for the auction sponsor's records. By way of example, FIG. 6 shows several reports that may be generated using the present invention. In those instances where a dinner is held in conjunction with the charitable auction, Table and Guest report 61 may be generated. "Bidder vs. Buyer" report 62 may generated to compare the number of bidding guests with the number of bidders actually making a purchase. Likewise, reports entitled "Spending" 63 and "Invoices" 64 give additional details concerning the distribution of revenues from the purchasing bidders. And, "Auction Results" 67 shows a break down by group of the items sold under various auction formats and displays a calculation of the revenue generated from each group.

From the foregoing it will be seen that this invention is one well adapted to attain all of the ends and objects hereinabove set forth, together with other advantages which are inherent to the method and the kit for performing that method.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A method for conducting an auction comprising the steps of:

identifying each of a plurality of potential bidders with a unique bidder code, said bidder code having a machine readable representation;

identifying each of a plurality of different auction items and each group of identical auction items with a unique item code, said item code having a machine readable representation;

identifying each of a plurality of incremental bid prices with a unique price code, said price code having a machine readable representation;

recording the sale of each item by recording the item, bidder and price codes defining the sale.

2. The method of claim 1, further comprising the step of preparing an invoice for each successful bidder, the invoice having the sum of the purchase prices of the sales associated with the bidder's code.

3. The method of claim 2, wherein the invoice is prepared before the auction's conclusion.

4. The method of claim 1, further comprising the step of providing potential bidders with means for bidding by registering their bidder codes in association with an auction item.

5. The method of claim 4, wherein potential bidders are provided with their respective bidder code printed on adhesive labels.

6. The method of claim 1, further comprising the step of preparing a bid sheet for an item, the sheet provided with the item code, multiple price codes representing various incremental values and spaces in association with each price code for registering a bidder code.

7. The method of claim 1, further comprising the step of preparing a bid sheet, the sheet provided with the item code and spaces for registering a bidder code and the bidder's desired price code.

8. The method of claim 1, further comprising the step of preparing a bid sheet for a group of identical auction items offered for sale at a fixed price, the sheet provided with an item code, price code and spaces for bidders to register a bidder code.

9. The method of claim 1, further comprising the step of preparing a bid sheet, the sheet provided with spaces for registering an item code, a bidder code and the bidder's desired price code.

10. The method of claim 1, wherein each sale is recorded by reading the machine readable representation of the bidder, item and price codes with optical or electronic means and storing the codes in a database.

11. The method of claim 10, further comprising the step of entering into the database before the auction an item description for each item code and bidder identifying data for each bidder code.

12. The method of claim 1, further comprising the step of entering into a database a potential or successful bidder's credit or debit card account information to facilitate obtaining payment from the bidder.

13. A kit for conducting an auction comprising, a bidder code for each of a plurality of potential bidders, said bidder code having a machine readable representation;

an item code for each of a plurality of auction items and for each group of identical auction items, said item code having a machine readable representation;

a price code for each of a plurality of incremental bid prices, said price code having a machine readable representation;

means for recording each sale as defined by the bidder, item and price codes associated with the sale; and means for preparing an invoice for each successful bidder, the invoice having the sum of the sales associated with the bidder.

14. The kit of claim 13, further comprising a printer.

15. The kit of claim 13, further comprising means for registering bidder codes in association with an auction item.

16. The kit of claim 15, wherein the means for bidding by registering bidder codes is a bid sheet for an item, the sheet provided with the item code, multiple price codes representing various incremental values and spaces in association with each price code for registering a bidder code.

17. The kit of claim 15, wherein the means for registering bidder codes is a bid sheet, the sheet provided with the item code and spaces for registering a bidder code and the bidder's desired price code.

18. The kit of claim 15, wherein the means for registering bidder codes is a bid sheet, the sheet provided with spaces for registering an item code, a bidder code and the bidder's desired price code.

19. The kit of claim 15, wherein the means for registering bidder codes is a bid sheet for a group of identical auction items offered for sale at a fixed price, the sheet provided with an item code, item price and spaces for bidders to register a bidder code.

20. The kit of claim 15, wherein bidder, item and price codes are printed on adhesive labels.

21. The kit of claim 13, wherein the means for recording the bidder, item and price codes comprise an optical or electronic device for reading the codes and a computer database for storing the codes.

22. The kit of claim 21, wherein the computer database contains a description for each item code and bidder identifying data for each bidder code.

23. The kit of claim 13, wherein the means for preparing a successful bidder's invoice or a report of auction sales is a data processing program.

* * * * *